US008261880B1

(12) United States Patent
Hop

(10) Patent No.: US 8,261,880 B1
(45) Date of Patent: Sep. 11, 2012

(54) STEP LADDER APPARATUS

(76) Inventor: Daryl J. Hop, Holland, MI (US)

( * ) Notice: Subject to any disclaimer, the term of this patent is extended or adjusted under 35 U.S.C. 154(b) by 1161 days.

(21) Appl. No.: 12/075,015

(22) Filed: Mar. 7, 2008

Related U.S. Application Data

(60) Provisional application No. 60/905,872, filed on Mar. 9, 2007.

(51) Int. Cl.
*E06C 5/04* (2006.01)

(52) U.S. Cl. ..... 182/93; 182/100; 182/106; 182/127; 182/206; 182/228.3; 182/228.4; 114/362

(58) Field of Classification Search ..... 182/93, 182/100, 106, 206, 228.3, 228.4, 127; 114/362
See application file for complete search history.

(56) References Cited

U.S. PATENT DOCUMENTS 372,982 A * 11/1887 Judd ..... 182/93
626,607 A 6/1899 Gentner
868,805 A * 10/1907 Peterson ..... 105/381
962,632 A 6/1910 Frost
1,333,990 A 3/1920 Mills
1,353,624 A * 9/1920 Bergstrom ..... 296/43
1,378,948 A 5/1921 Hage
1,553,785 A 9/1925 Ley
2,364,521 A * 12/1944 Fairfax ..... 182/93
2,638,375 A 5/1953 Jewell
3,033,309 A 5/1962 Fugere
3,299,984 A 1/1967 Svedahl
3,596,426 A 8/1971 Loov
3,598,200 A * 8/1971 Thompson ..... 182/8
3,674,304 A 7/1972 Swanson
3,841,695 A 10/1974 Woodward
3,869,742 A 3/1975 Gale et al.
3,940,179 A * 2/1976 McBride ..... 296/43
4,388,983 A 6/1983 Bartels et al.
4,553,358 A 11/1985 Deike
4,892,170 A * 1/1990 O'Donnell ..... 182/100
5,024,292 A 6/1991 Gilbreath et al.
5,113,782 A * 5/1992 McCarty ..... 114/362
5,163,531 A 11/1992 Whiting
D359,134 S 6/1995 Toews
5,687,813 A * 11/1997 Bensch ..... 182/127
5,848,502 A 12/1998 Schaefer
5,860,490 A 1/1999 Petti et al.
5,964,317 A 10/1999 Lattavo
6,003,633 A 12/1999 Rolson
6,260,662 B1 * 7/2001 Meister et al. ..... 182/106
6,321,873 B1 11/2001 LaBrash
6,505,708 B2 1/2003 LaBrash (Continued)

*Primary Examiner* — Katherine W Mitchell
*Assistant Examiner* — Colleen M Chavchavadze
(74) *Attorney, Agent, or Firm* — The Watson I.P. Group, PLC; Jovan N. Jovanovic; Vladan M. Vasiljevic

(57) ABSTRACT

A step ladder apparatus for retention within a stake pocket comprising a frame assembly a plurality of step assemblies and an attachment assembly. The attachment assembly includes a frame flange and a wedge member. The frame assembly is positioned within the stake pocket so that the frame flange overhangs one end of the stake pocket. The base of the wedge member is inserted into the stake pocket opposite the frame flange so that the wedge flange overhangs the stake pocket on a side opposite the frame flange. As a result, the flanges cooperate to substantially preclude downward movement of the frame assembly, and, in turn, removal of the frame assembly in a downward direction from the stake pocket.

14 Claims, 8 Drawing Sheets

U.S. PATENT DOCUMENTS

| | | | | |
|---|---|---|---|---|
| 6,578,666 | B1 | 6/2003 | Miller | |
| 6,857,677 | B1 | 2/2005 | Giles et al. | |
| 7,003,919 | B2 | 2/2006 | Riker | |
| 7,025,174 | B1 | 4/2006 | Hawley | |
| 7,108,103 | B2 * | 9/2006 | Meeker | 182/165 |
| 2004/0016598 | A1 * | 1/2004 | Verdijk | 182/100 |

* cited by examiner

STEP LADDER APPARATUS

CROSS-REFERENCE TO RELATED APPLICATION

This application claims priority from U.S. Provisional Application Ser. No. 60/905,872 filed Mar. 9, 2007, entitled "Light Weight, Portable truck and trailer ladder that easily attaches with the use of a locking wedge key," the entire specification of which is hereby incorporated by reference in its entirety.

BACKGROUND OF THE DISCLOSURE

1. Field of the Disclosure

The disclosure relates in general to step ladder apparatus, and more particularly, to a step ladder apparatus which is configured to be releasably retained within a stake pocket of a trailer of a tractor-trailer. The step ladder apparatus is designed to aid a user to climb onto the trailer. When not in use, the step ladder apparatus can be removed from the stake pocket and stowed.

2. Background Art

The use of step ladders is known in the art. Generally, step ladders have been provided to facilitate the climbing onto a trailer of a tractor-trailer. Indeed, a number of solutions have been developed to provide a step ladder for such use. The include U.S. Pat. No. 6,003,633 issued to Rolson; U.S. Pat. No. 5,964,317 issued to Lattavo; U.S. Pat. No. 5,024,292 issued to Gilbreath et al; U.S. Pat. No. 6,578,666 issued to Miller; U.S. Pat. No. 5,163,531 issued to Whiting; U.S. Pat. No. 3,033,309 issued to Fugere; U.S. Pat. No. 5,687,813 issued to Bensch; U.S. Pat. No. 6,505,708 issued to LaBrash; U.S. Pat. No. 6,321,873 issued to LaBrash; U.S. Pat. No. 7,025,174 issued to Hawley; and D359,134 issued to Toews.

While these have provided some utility, there have been drawbacks. Many of these step ladders require permanent attachment, and as such are of limited applicability. Other step ladders are difficult to attach to the trailer, or lack the required stability necessary to provide confidence and useability. Still others are cumbersome and difficult to store. Furthermore, such step ladders must be removed prior to driving or operating the trailer.

It is an object of the present invention to provide for a step ladder which does not suffer from the foregoing problems.

It is another object of the present invention to provide for a step ladder which includes a handle that can be coupled to the frame when not in use.

It is another object of the invention to provide for a step ladder that can easily and securely be attached to existing trailer structures with relative ease.

These objects as well as other objects of the present invention will become apparent in light of the present specification, claims, and drawings.

SUMMARY OF THE DISCLOSURE

The disclosure is directed to a step ladder apparatus for use in association with a trailer. The step ladder is primarily configured for retention within a stake pocket or the like formed about the outer perimeter of the trailer. The step ladder apparatus includes a frame assembly, a plurality of step assemblies, and an attachment assembly. The frame assembly has a first end and a second end. The frame assembly comprises an elongated member having a front wall and opposing sides. A plurality of step assemblies are spaced apart from each other and positioned along the frame assembly between the first and second ends thereof. The attachment assembly comprises a frame flange extending outwardly proximate the first end and in a direction away from one of the opposing sides of the frame assembly.

The wedge member comprises a base and a flange member extending therefrom. The base of the wedge and the frame assembly together substantially correspond to the width of a stake pocket. The frame assembly is positioned within the stake pocket so that the frame flange overhangs one end of the stake pocket and the base of the wedge member is inserted into the stake pocket opposite the frame flange so that the flange of the wedge overhangs the stake pocket on a side opposite the frame flange. The flanges cooperate to substantially preclude downward movement of the frame assembly, and, in turn, removal of the frame assembly in a downward direction from the stake pocket.

In a preferred embodiment, the step ladder apparatus further comprises a handle member releasably attachable to the frame assembly proximate the first end thereof.

In another preferred embodiment, the plurality of step assemblies each include a pair of opposing brackets and a step member. The opposing brackets are coupled to the frame assembly at one end and to the step member at the other end. The step member extends across the front of the frame assembly and is spaced apart from the front of the frame assembly. The front of the frame assembly, the opposing brackets and the step member define a slot. The slot is configured to receive the handle member therethrough, to in turn, provide for stowage of the handle between the step member and the front of the frame assembly.

In a preferred embodiment, the plurality of step assemblies comprises three spaced apart step assemblies, each of which has a substantially identically defined slot.

In another preferred embodiment, the handle member comprises an elongated member with a loop handle at a first end thereof. The second end of the elongated member includes a tab portion. The first end of the frame assembly includes a slot configured to releasably receive the tab of the second end of the elongated member to, in turn, attach the handle to the frame assembly.

In another preferred embodiment, the wedge member further comprises means for adjusting the width thereof.

In another preferred embodiment, the width adjustment means comprises a pair of fasteners which are selectively threadable into corresponding openings in the base. The relative positioning of the pair of fasteners together with the base defines a width of the wedge member.

In another preferred embodiment, the step assemblies include a opposing bracket members coupled to a step member. The opposing bracket members are attached to the frame with a fastener. Each of the opposing bracket members include a surface configuration, and, the sides of the frame assembly include mating surface configurations, wherein the surface configurations of the opposing bracket members couple to the mating surface configurations of the frame assembly. In turn, rotation of the respective bracket member and the frame relative to each other is minimized.

In a preferred embodiment, the surface configurations comprise a plurality of substantially vertical ribs extending along the respective surfaces of the opposing bracket and the sides of the frame assembly.

In another preferred embodiment, the step ladder apparatus further comprises means for locking the wedge, the handle and the frame assembly to each other.

In another preferred embodiment, the locking means comprises a lock opening extending through each of the wedge, the frame assembly and the handle member. A lock is extendable through each lock opening, and securable therethrough.

In another aspect of the invention, the invention comprises a method of coupling a step ladder apparatus to a stake pocket comprising the steps of: inserting a frame assembly into a stake pocket, the frame assembly having a plurality of step assemblies coupled to the frame assembly and positioned below the stake pocket; positioning the frame assembly so that a first flange at a top end thereof overhangs a wall of the stake pocket; providing a wedge having a base and a second flange; and inserting a base of the wedge into the stake pocket between the frame assembly and an opposing side wall of the stake pocket such that the flange overhangs the stake pocket, so that the first flange and the flange of the wedge cooperate to releasably couple the frame assembly to the stake pocket and to preclude downward movement of the frame assembly relative to the stake pocket.

In a preferred embodiment, the method further comprises the steps of: providing a handle member; and releasably attaching the handle member to the frame assembly.

In another preferred embodiment, the step ladder assembly further includes a plurality of slots defined by each seat assembly in cooperation with the frame assembly, and a handle member. In such an embodiment, the method further comprises the steps of: releasing the handle member from the frame assembly; and sliding the handle member through each slot so as to position the handle member in a stowed orientation.

In a preferred embodiment, the method further comprises the step of: adjusting the width of the wedge so as to accommodate the width of the stake pocket prior to the step of inserting;

BRIEF DESCRIPTION OF THE DRAWINGS

The disclosure will now be described with reference to the drawings wherein.

DETAILED DESCRIPTION OF THE DISCLOSURE

Figure 1:
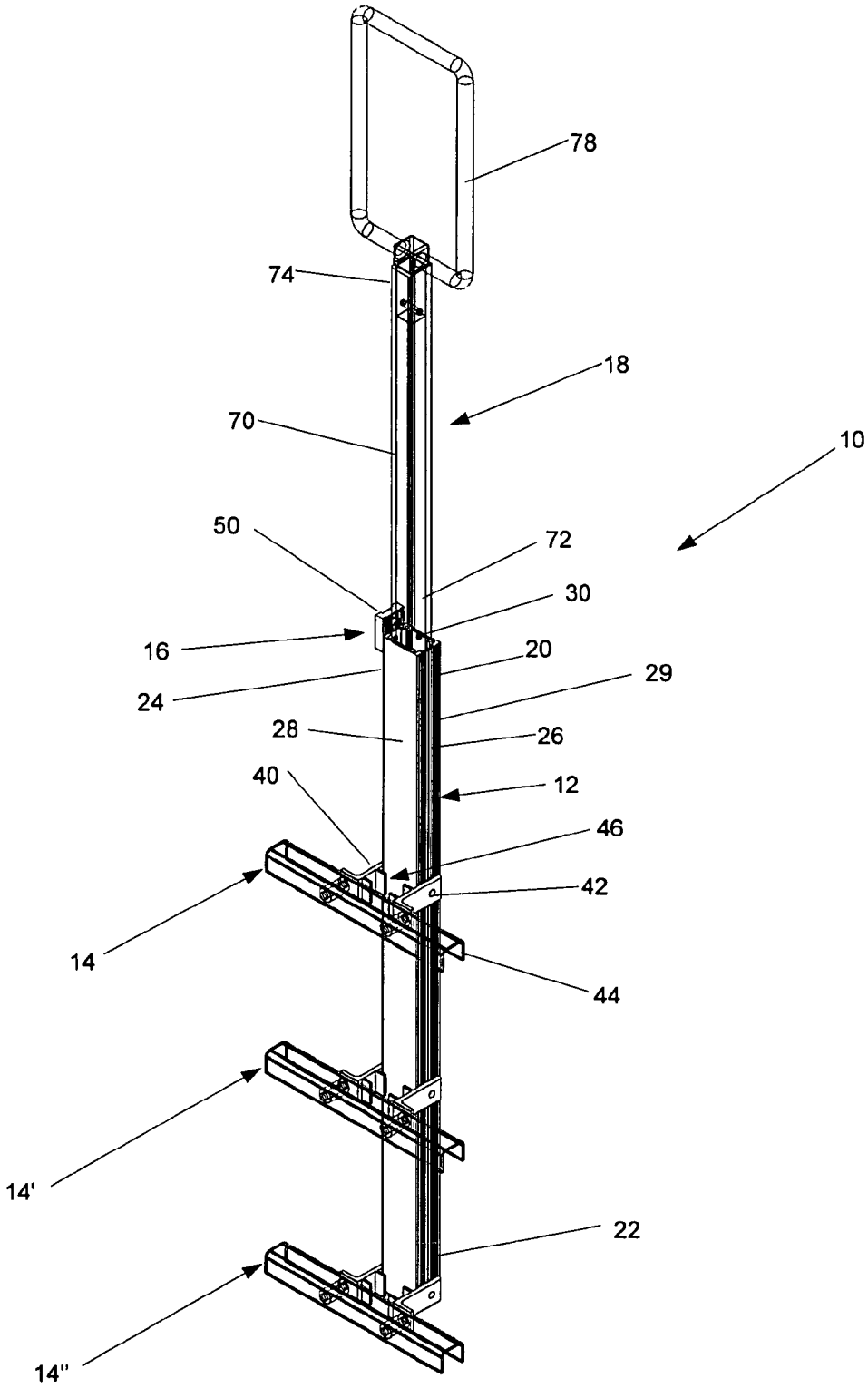
FIG. 1 of the drawings comprises a perspective view of a step ladder apparatus of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the step ladder apparatus is shown generally at 10. The step ladder apparatus includes frame assembly 12, step assembly 14, attachment assembly 16 and handle assembly 18. The step ladder apparatus is structurally configured for insertion and attachment to a stake pocket of a trailer of a tractor-trailer, such as stake pocket 100 shown in FIGS. 2 and 7-9. Generally, such stake pockets are positioned discretely about the outside perimeter of the trailer 110 (FIG. 7), and in particular the sides and back thereof. The stake pockets are formed from a single piece of material (or multiple pieces) which is bent so that in cooperation with the side or the back of the trailer, forms a generally rectangular opening or slot. Of course, the dimensions of this slot can be varied to accommodate differently sized stakes. Generally, however, the stake pockets are approximately 1.5 inches thick and 3.5 inches wide forming a rectangle. Of course, the invention is not limited to any particular size or shape.

Figure 8:
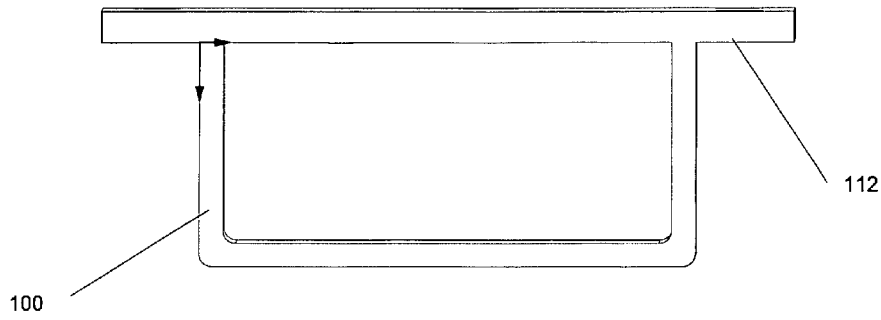
FIG. 8 of the drawings comprises a top plan view of the stake pocket within which the step ladder apparatus fits within.
Figure 9:
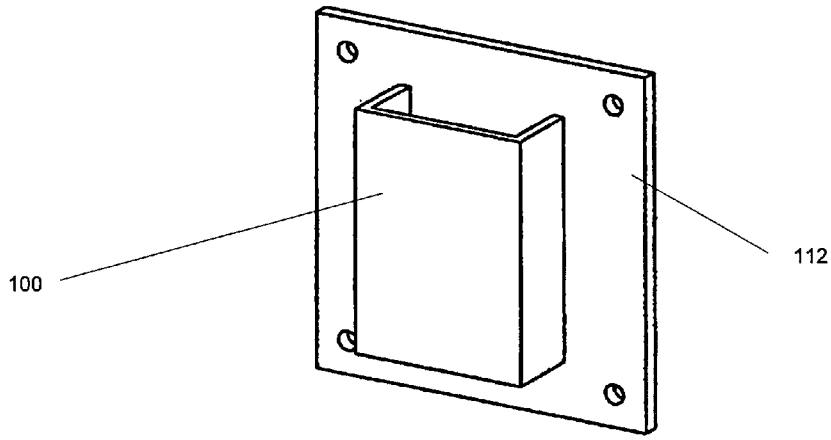
FIG. 9 of the drawings comprises a top plan view of a user assemblable stake pocket within, which the step ladder apparatus fits within.

With reference to FIGS. 8 and 9, it is also contemplated that a separate bracket 112 with a stake pocket 100 may be supplied to attach to trailers that are void of any stake pockets to form a stake pocket. It will be understood that a number of differently configured brackets and braces on the side of a trailer are deemed to be within the scope of the term stake pocket, without limitation. Additionally, it will be understood that the term stake pocket additionally covers within its scope and meaning, a bracket or the like coupled to a structure other than a trailer, such as, for example, a loading dock, or an implement, among others.

Figure 2:
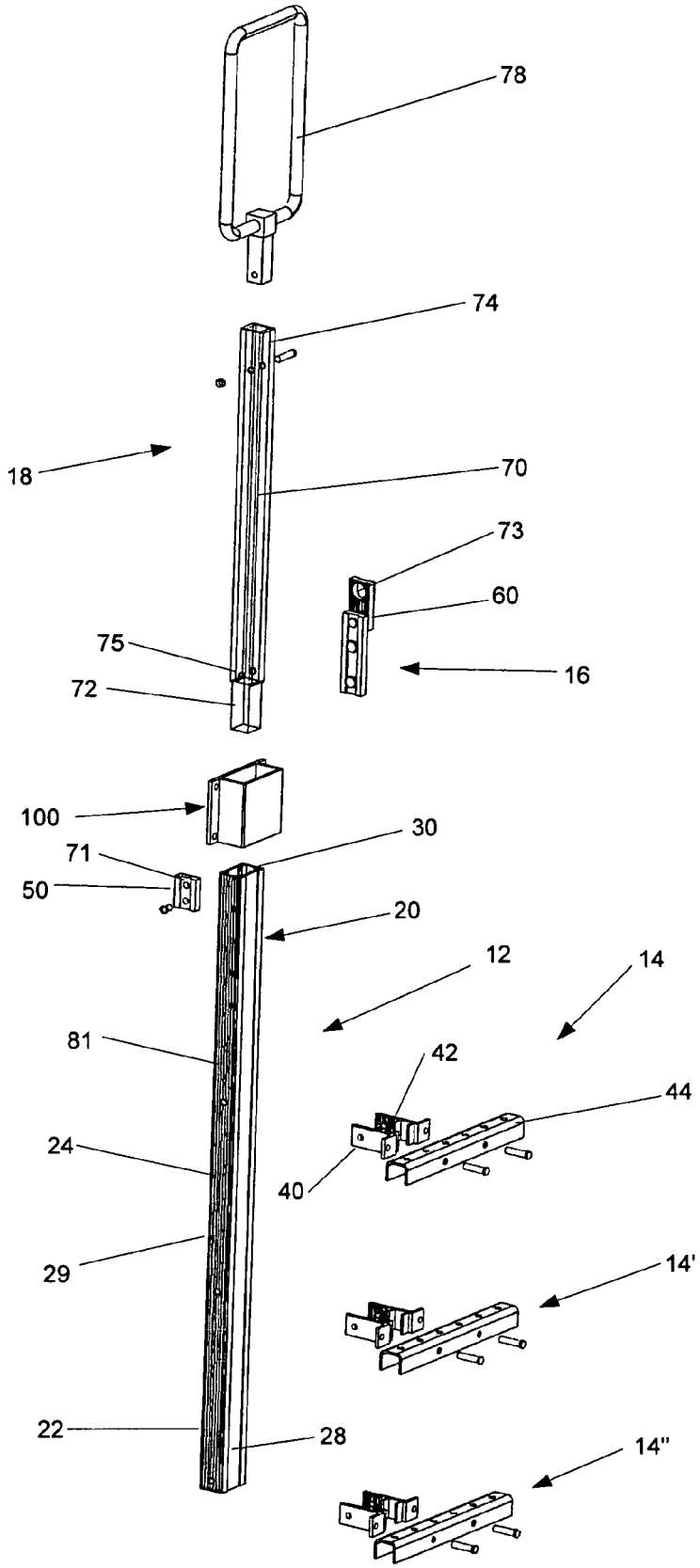
FIG. 2 of the drawings comprises an exploded perspective view of a step ladder apparatus of the present invention, showing, as well the wedge member and the stake pocket.
Figure 3:
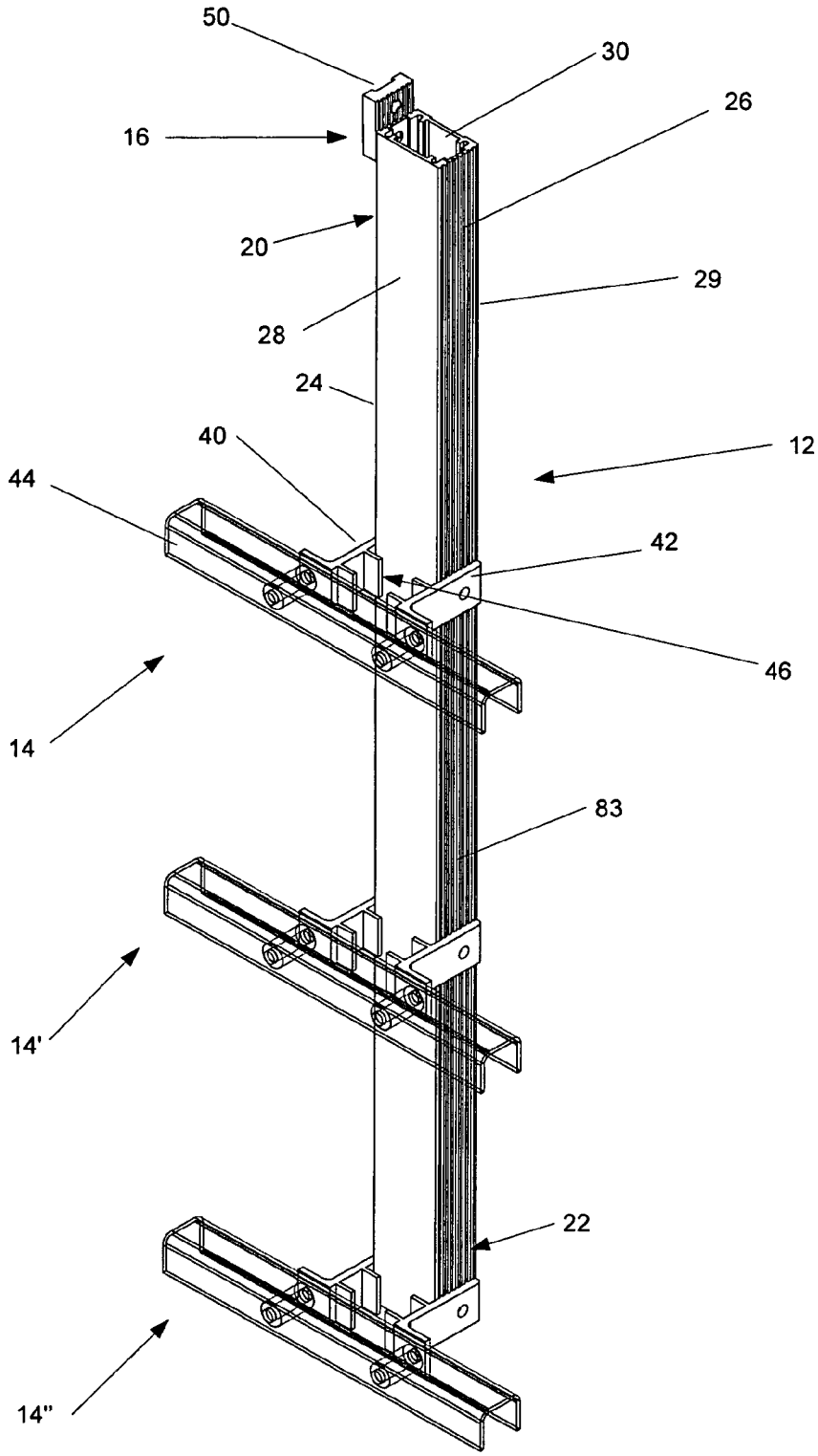
FIG. 3 of the drawings comprises a perspective view of a step ladder apparatus of the present invention having the handle assembly removed.

The frame assembly 12 is shown in FIGS. 2 and 3 as comprising first end 20, second end 22, side walls 24 and 26, front wall 28, back wall 29. The first end 20 includes central bore 30. The frame assembly is elongated such that the length thereof is in excess of 24" and dimensions between 15" and 45" are contemplated (without limitation). It is contemplated that the frame assembly comprises a substantially uniform rectangular configuration with each of the width and thickness dimensions being smaller than corresponding stake pockets so that a portion of the frame assembly can extend into the stake pocket.

It is contemplated that the central bore 30 extends through the entirety of the frame assembly to facilitate a reduction in weight. The frame assembly, it is contemplated, comprises an extruded aluminum, although other structures and materials are contemplated. In certain embodiments, the frame assembly may comprise a c-channel having only a partial back wall near the first end to form a central bore 30.

With reference to FIGS. 2 and 3, the side walls 24, 26 of the frame assembly includes surface configurations 81, 83 which form a plurality of ribs extending therealong. In the embodiment shown, the plurality of ribs comprise a number of parallel series of ribs extending along substantially the entire length of the side walls. As will be explained these ribs cooperate with complementary ribs 91, 93 (FIG. 5) on the step assembly brackets so as to limit rotation of the step assembly relative to frame assembly. The ribs can be formed as the frame member is extruded.

Figure 5:
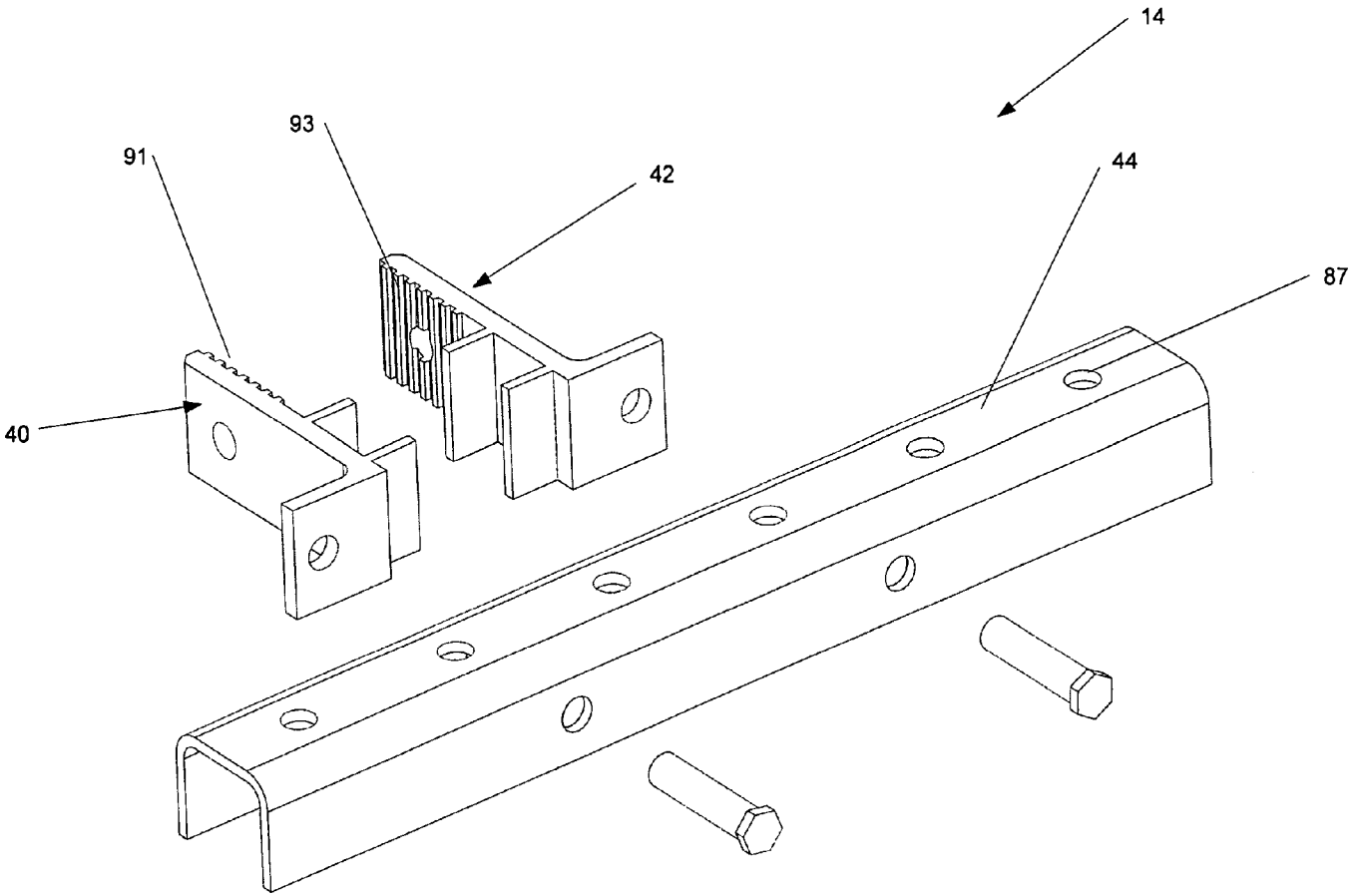
FIG. 5 of the drawings comprises an exploded view of a step assembly of the present invention.
Figure 6:
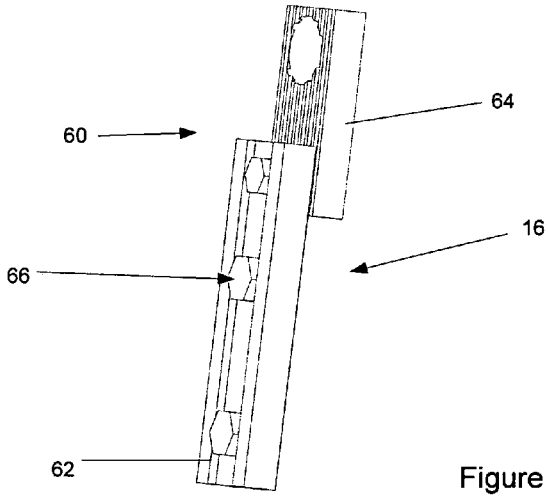
FIG. 6 of the drawings comprises a perspective view of a wedge member of the present invention.

Step assembly 14 is shown in FIGS. 1 and 5 as comprising opposing arm brackets 40, 42 and step member 44. Step assembly 14 will be described in detail with the understanding that each of the step assemblies 14, 14', and 14" (FIG. 1) are substantially identical in the present embodiment (although not required). The opposing arm brackets 40, 42 each include a first end which is coupled to a respective side wall 24, 26 of the frame assembly 12. The opposing arm brackets extend away from the side wall outwardly so as to straddle the front surface therebetween. In the embodiment shown, each bracket comprises a separate member which is attached to the side of the frame assembly with threaded fasteners. In other embodiments, the brackets may comprise a single integral member. Additionally, the brackets may be welded to respective side walls. In yet other embodiments, the bracket members can be designed so as to be coupled to (or to extend from) the front or back wall 28, 29, respectively, as desired.

Preferably, the step member 44 is coupled to the second ends of the brackets 40, 42 and the step member extends across the front wall 28 of the frame assembly. Typically, the step member 44 is wider than the front wall 28. The step member, in the embodiment shown, includes upper surface 45 which is substantially perpendicular to the front wall and perpendicular to the frame assembly, such that in operable positioning, the upper surface 45 is substantially parallel to the trailer bed so that the user can easily utilize the upper surface 45 as a step. The upper surface 45 includes a plurality of openings 87 (FIG. 5), or other features which provide an enhanced grip for the shoe sole of the user. While a number of different configurations are contemplated, the step member comprises a C-channel which is attached with fasteners to the respective brackets 40, 42.

In the embodiment shown, the step member 44 is spaced apart from the front wall 28 of the frame assembly 12. In such a configuration, the step member, the brackets 40, 42 and the front wall 28 of the frame assembly 12 cooperate to form opening/slot 46. As will be explained below, and with reference to FIG. 10, the opening is configured to receive a portion of the handle member so as to facilitate a compact compressed configuration to the step ladder apparatus. In other embodiments, it is contemplated that the step member 44 abuts the front wall of the frame assembly such that no opening is formed. In other embodiments, the step member 44 may include a single or multiple discrete elements that are spaced apart from each other and that, for example emanate from opposing side walls 24, 26 of the frame assembly.

Figure 7:
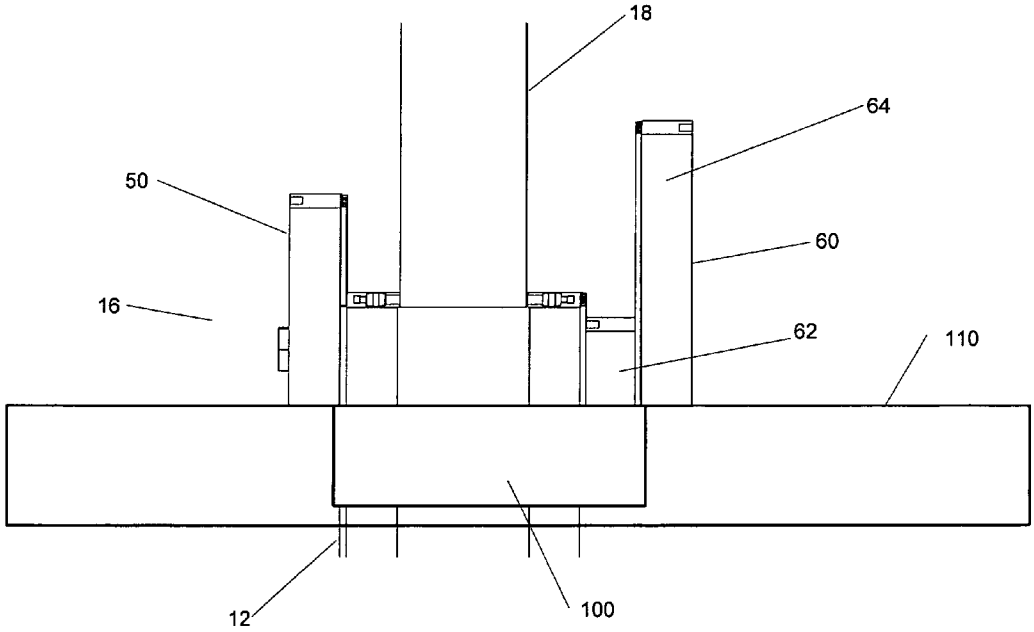
FIG. 7 of the drawings comprises a partial front elevational view of the step ladder apparatus in operative positioning within a stake pocket.

With reference to FIGS. 2 and 7, step ladder attachment assembly 16 includes flange 50 and wedge member 60. The flange 50 is coupled to one of the side walls, and in the embodiment shown, to the side wall 24 of the frame assembly 12. The flange extends outwardly from the side wall 24 a predetermined distance, such as 0.5" or the like. In the embodiment shown, the flange is positioned at the first end 20 of the frame assembly. It will be understood that in other embodiments, the flange member may be spaced apart from the first end of the frame assembly. The flange member may be one of welded, adhered or fastened to the side wall (or the front or back walls) of the frame assembly.

Wedge member 60 is shown in FIG. 2 as comprising base 62 and wedge flange 64 and means 66 for widening the wedge member. The base 62 has a width that is nominally such that the width of the base together with the width of the frame assembly 12 substantially corresponds to the width of the stake pocket. Where presented with a wider stake pocket, the base widening means can be employed. As is shown in FIG. 2, the widening means comprises a plurality of screws that are threaded into base 62. By adjusting these screws within the threads of the base, the effective width of the base can be varied, as it is in part defined by the position of the screws. The wedge flange 64 extends outwardly from the base at one end thereof. In another embodiment, the wedge member may additionally include shims or other devices to provide a widened wedge member, as the widening means. In still other embodiments, the side of the frame assembly may include widening means, so that the frame assembly is widened as opposed to the wedge member.

Figure 4:
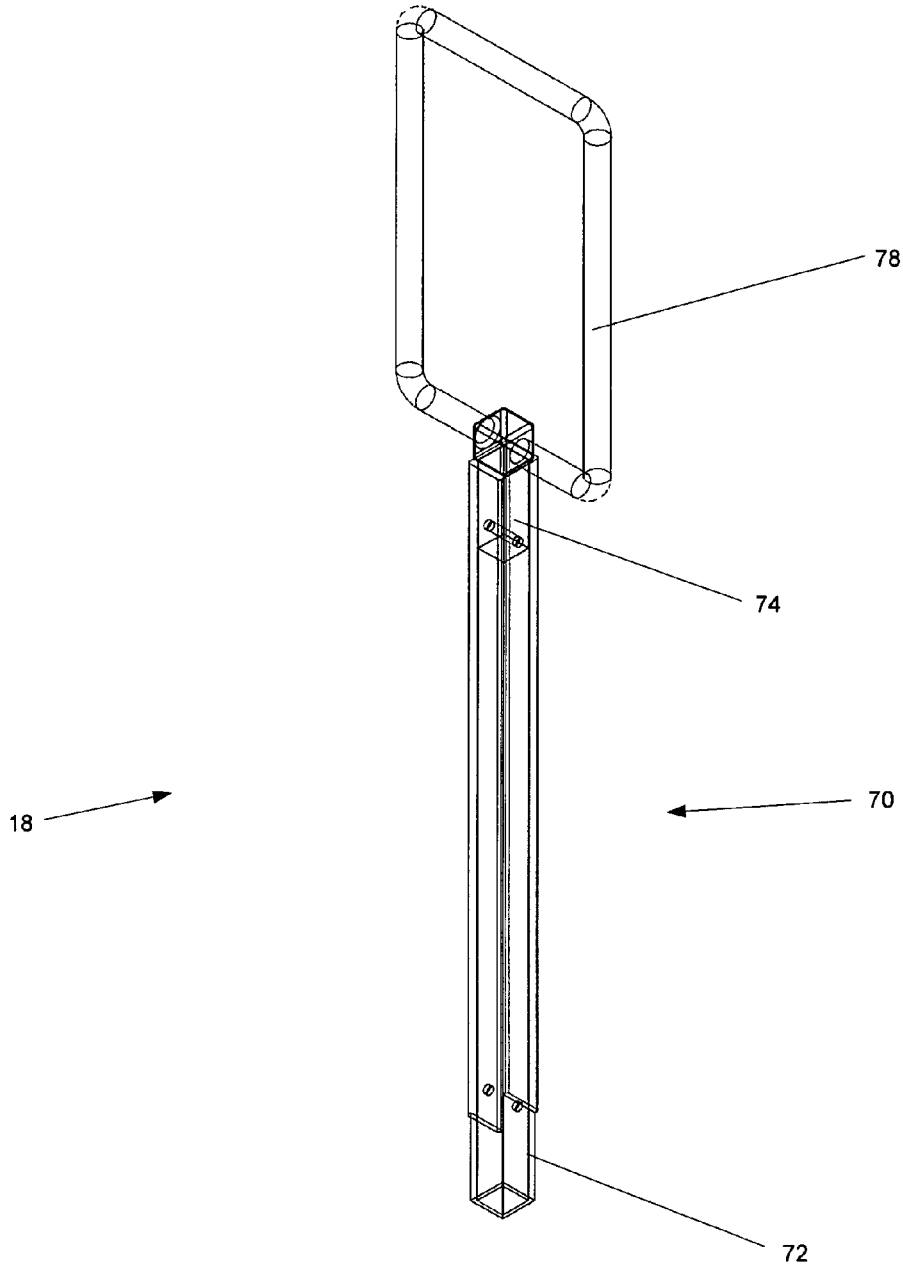
FIG. 4 of the drawings comprises a perspective view of a handle assembly of the present invention.

The handle assembly 18 is shown in FIG. 4 as comprising post member 70 and grasping ring 78. The post member 70 includes first end 72 and second end 74. The first end includes a tab which is configured to matingly engage with central bore 30. With reference to FIG. 1, by inserting the tab into the central bore 30, the handle assembly can be releasably attached to the frame assembly such that it is in operable position for use. The grasping ring 78 is attached to the second end 74 of the post member 70 and provides a region for a user to grasp and retain when utilizing the ladder.

In the embodiment shown, the post member comprises an elongated member that is extruded. The first end of the elongated member includes a tapered region which defines the tab. The second end includes a central bore. The grasping ring comprises an elongated generally elliptical member which is cast and which has a tab that can be accommodated within the central bore. A fastener or other suitable means, such as adhesive, welding and the like, can be employed to join the grasping ring to the post member.

With reference to FIG. 2, the frame flange, the wedge flange and the handle assembly may each include openings 71, 73, 75, respectivelywhich are substantially collinear. In that manner, the frame assembly, wedge member and handle assembly can be locked together by inserting a lock through the openings, such as an elongated padlock (not shown). In other embodiments, a wire or other harness may be employed in place of the padlock.

In operation, a user first determines where the step ladder apparatus is to be utilized. Once a desired stake pocket has been selected, the user can insert the frame assembly into the stake pocket. Inasmuch as the step assemblies which are between the first and second end of the frame assembly are wider than the stake pocket, the frame assembly is inserted from below the stake pocket. After the first end is directed through the stake pocket, the flange 50 is positioned such that it overlies a side wall of the stake pocket. In such a position, the side wall from which the flange 50 emanates generally abuts the stake pocket side wall.

Next, the user grasps wedge member 60 and inserts the wedge member into the stake pocket between the side wall opposite flange 50. The wedge member is inserted so that the base 62 generally abuts the side wall 26 of the frame assembly. As the wedge member is lowered, the wedge flange 64 engages the side wall of the stake pocket opposite the flange 50. Such a configuration is shown in FIG. 7. The width of the base of the wedge member and the frame assembly generally corresponds to the width of the stake pocket, such that upon insertion of the wedge, the two flanges cooperate to retain the wedge and the frame assembly in the desired orientation.

Essentially, the step ladder apparatus is now releasably locked in position. Once it is locked into the stake pocket, the user can then grasp the handle assembly. In certain embodiments, the handle assembly is slid through the openings 46 formed by the step assembly in cooperation with the frame assembly so that the handle overlies the front wall 28 of the frame assembly. In other embodiments, the handle assembly is separately stowed and provided.

The handle assembly is raised so that the tab at the first end of the post member 70 of the handle assembly 18 can be inserted into the central bore 30 of the frame assembly. The dimensions of the tab and the central bore are such that a tight fit is achieved. The step ladder assembly is now fully assembled and ready for use. To utilize the step ladder assembly, the user can grasp the handle assembly and sequentially step on the step assemblies to eventually climb onto the trailer. Due to the relatively tight fit of the wedge (which can be width adjusted) and the frame assembly within the stake pocket, the step ladder apparatus is generally securely mounted to the stake pocket, and is substantially precluded from even small oscillations or movements.

To further secure the step ladder apparatus, the user can extend a padlock or the like through the respective openings on the flange 50, the post member of the handle assembly 18 and the wedge member so as to lock these assemblies relative to each other.

The step ladder apparatus can be maintained in the articulated and coupled condition as desired. However, the step ladder apparatus can be removed for stowage when it is not in use, or when the trailer is in use. To remove the step ladder apparatus from the trailer, the user first removes the handle member from the frame assembly, by pulling the tab of the post member from within the central bore.

Figure 10:
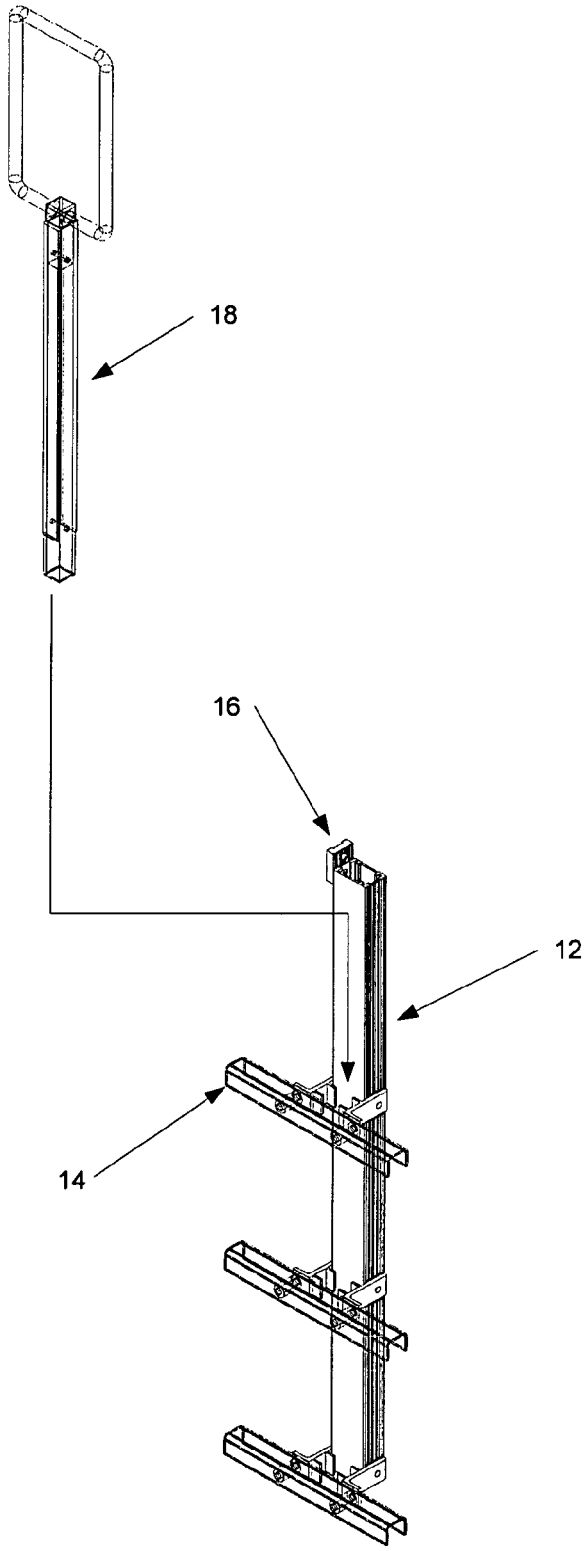
FIG. 10 of the drawings comprises a perspective view of the handle assembly and the frame assembly showing, in particular, an assembly procedure for positioning the handle assembly within the openings formed by the frame assembly and the step assembly.

Next, the user removes the wedge member from within the stake pocket. By removing the wedge member, the user can then slide the frame assembly so that the flange 50 no longer overlies a side wall of the stake pocket. The user can then drop the frame assembly through the stake pocket to completely disconnect the two components. With reference to FIG. 10, the handle member can then be extended through the openings 46 formed in each step assembly so that the handle member overlies the front wall 28 of the frame assembly. The padlock can be extended through the opening in the handle member so as to be positioned between two adjacent step assemblies. Thus, the padlock precludes removal of the handle member from the openings of the step assembly.

Additionally, the user can rotate the frame assembly a half turn so that the step assembly is turned inward. The user can then couple the frame assembly to the stake pocket. In this manner, the user can stow the frame assembly in the stake pocket, with the components on the inside so that it does not stick out beyond the side of the trailer (so as to minimize the potential for destroying or damaging the same). Additionally, the stowed apparatus does not hamper the operation of the trailer. It will be understood that such an orientation can be achieved with the handle deployed or removed.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A step ladder apparatus for use in association with a trailer, the step ladder configured for retention within a stake pocket, comprising:

a frame assembly having a first end and a second end, the frame assembly comprising an elongated member having a front wall and opposing sides;

a plurality of step assemblies spaced apart from each other and positioned along the frame assembly between the first and second ends thereof;

an attachment assembly comprising:

a frame flange coupled to the frame assembly and extending outwardly proximate the first end and in a direction away from one of the opposing sides of the frame assembly; and a wedge member separate from the frame assembly and the frame flange, the wedge member comprising a base and a wedge flange member extending therefrom, in operable engagement, the base spacing the wedge flange apart from the frame assembly, the base of the wedge member and the frame assembly together substantially corresponding to the width of the stake pocket;

whereupon the frame assembly is positioned within the stake pocket so that the frame flange overhangs one end of the stake pocket and whereupon the base of the wedge member is inserted into the stake pocket opposite the frame flange so that the base spaces the wedge flange apart from the frame assembly and so that the wedge flange overhangs the stake pocket on a side opposite the frame flange, the flanges cooperate to substantially preclude sideways and downward movement of the frame assembly, and, in turn, removal of the frame assembly in a downward direction from the stake pocket.

2. The step ladder apparatus of claim 1 further comprising a handle member releasably attachable to the frame assembly proximate the first end of the frame assembly.

3. The step ladder apparatus of claim 2 wherein the plurality of step assemblies each include a respective pair of opposing brackets and a respective step member, the respective opposing brackets coupled to the frame assembly at one end and to the step member at the other end, the respective step member extending across the front of the frame assembly and spaced apart from the front of the frame assembly, wherein the front of the frame assembly, the respective opposing brackets and the respective step member define a slot, the slot being configured to receive the handle member therethrough, to in turn, provide for stowage of the handle between the respective step member and the front of the frame assembly.

4. The step ladder apparatus of claim 3 wherein the plurality of step assemblies comprises three spaced apart step assemblies, each of which has a substantially identically defined slot.

5. The step ladder apparatus of claim 2 wherein the handle member comprises an elongated member with a loop handle at a first end thereof, the second end of the elongated member includes a tab portion, the first end of the frame assembly includes a slot configured to releasably receive the tab of the second end of the elongated member to, in turn, attach the handle to the frame assembly.

6. The step ladder apparatus of claim 1 wherein the wedge member further comprises means for adjusting the width thereof.

7. The step ladder apparatus of claim 6 wherein the width adjustment means comprises a pair of fasteners which are selectively threadable into corresponding openings in the base wherein the relative positioning of the pair of fasteners together with the base defines a width of the wedge member.

8. The step ladder apparatus of claim 1 wherein the step assemblies include a opposing bracket members coupled to a step member, the opposing bracket members are attached to the frame with a fastener, each of the opposing bracket members include a surface configuration, the sides of the frame assembly include mating surface configurations, wherein the surface configurations of the opposing bracket members couple to the mating surface configurations of the frame assembly, to in turn, minimize rotation of the respective bracket member and the frame relative to each other.

9. The step ladder apparatus of claim 8 wherein the surface configurations comprise a plurality of substantially vertical ribs extending along the respective surfaces of the opposing bracket and the sides of the frame assembly.

10. The step ladder apparatus of claim 1 further comprising means for locking the wedge, the handle and the frame assembly to each other.

11. The step ladder apparatus of claim 10 wherein the locking means comprises a lock opening extending through each of the wedge, the frame assembly and the handle member and a lock extendable through each lock opening, and securable therethrough.

12. A method of coupling a step ladder apparatus of claim 1 to a stake pocket comprising the steps of:

inserting a frame assembly into the stake pocket, the frame assembly having a plurality of step assemblies coupled to the frame assembly and positioned below the stake pocket;

positioning the frame assembly so that a first flange at a top end thereof overhangs a wall of the stake pocket;

providing a wedge having a base and a second flange;

inserting a base of the wedge into the stake pocket between the frame assembly and an opposing side wall of the stake pocket such that the flange overhangs the stake pocket, so that the first flange and the flange of the wedge cooperate to releasably couple the frame assembly to the stake pocket and to preclude downward movement of the frame assembly relative to the stake pocket.

13. The method of claim 12 further comprising the steps of:

providing a handle member; and releasably attaching the handle member to the frame assembly.

14. The method of claim 13 wherein the step ladder assembly further includes a plurality of slots defined by each seat assembly in cooperation with the frame assembly, and a handle member, the method further comprising the steps of:

releasing the handle member from the frame assembly; and sliding the handle member through each slot so as to position the handle member in a stowed orientation.

* * * * *